US005433451A

United States Patent [19]

De Vries

[11] Patent Number: 5,433,451

[45] Date of Patent: Jul. 18, 1995

[54] MECHANISED BALLISTIC TARGET

[76] Inventor: Jacobus M. De Vries, P.O. Box 2124, Rensburg, 2401, Transvaal, South Africa

[21] Appl. No.: 52,152

[22] Filed: Apr. 23, 1993

[30] Foreign Application Priority Data

Apr. 24, 1992 [ZA] South Africa ..... 92/0736

[51] Int. Cl.[6] ..... F41J 7/04

[52] U.S. Cl. ..... 273/392; 273/406

[58] Field of Search ..... 273/392, 391, 386, 340, 273/406, 407, 359, 366, 367, 368, 369, 370

[56] References Cited

U.S. PATENT DOCUMENTS

| | | | |
|---|---|---|---|
| 2,805,066 | 9/1957 | Mongello | 273/406 |
| 3,194,066 | 7/1965 | Schwab et al. | 273/392 |
| 3,392,980 | 7/1968 | Ortega | 273/406 |
| 4,540,182 | 9/1985 | Clement | 273/392 |
| 5,240,258 | 8/1993 | Bateman | 273/392 |

FOREIGN PATENT DOCUMENTS

| | | | |
|---|---|---|---|
| 670810 | 5/1939 | Germany | 273/392 |
| 0647417 | 1/1985 | Switzerland | 273/392 |

*Primary Examiner*—Mark S. Graham
*Attorney, Agent, or Firm*—McGlew & Tuttle

[57] ABSTRACT

A mechanised ballistic target presents a hinged target plate which is knocked down out of sight when hit by a bullet and the shock of the bullet impact on the plate is absorbed pneumatically by a rubber suction cup which the plate strikes; the suction cup has an air leakage passage defined by a capillary tube which sets a time delay before the suction cup releases the target plate to allow a spring to return the target plate to a ready position for the next shot.

16 Claims, 5 Drawing Sheets

MECHANISED BALLISTIC TARGET

BACKGROUND OF THE INVENTION

1. Field of invention

The field of this invention includes target shooting and the equipment used in this practice and in shooting ranges. Shooting ranges, of course, cover a wide diversity of weapons from hand guns and small arms to heavy calibre and high velocity rifles and carbines. Apart from standardised fixed targets silhouette shooting is also used in competitive and training activities.

2. Background of the Invention

Cardboard targets, whether concentric rings or otherwise or silhouettes are often pinned up on a target stand so that the holes penetrating the target indicate the success or otherwise of the shoot and the cardboard targets are discarded after each shoot. For longer range shooting targets have been used which drop when struck by the bullet indicating to the shooter that he has hit the target. In some ranges, for example at Bisley competitions and in military shoots a trench is provided behind such targets in which persons can shelter who, after each shoot can lift the target again or who can signal the accuracy or otherwise of the hit. Ordinary shoots can generally not afford such persons and commonly the marksmen are faced with the inconvenience of having to walk to the targets to check the success of their shoots after, for example each group of shots.

SUMMARY AND OBJECTS OF THE INVENTION

An object of the invention is to provide a mechanised ballistic target which returns automatically to an upright ready position after a selected time delay.

A further object of the invention is to provide this time delay by a pneumatic device which simultaneously serves as a shock absorbing device to absorb the shock of the bullet impact on the target.

A further object of the invention is to provide a mechanised ballistic target which is easily adaptable to suit usage with firearms of differing calibres, bullet velocities and ranges.

A further object of the invention is to provide a mechanised ballistic target which is easily transportable and stackable.

Accordingly a mechanised ballistic target in accordance with this invention comprises a base, a target plate hingedly mounted on the base, a spring connected to act between the base and target plate tending to raise the target plate in hinged movement to a ready position to be shot at, a pneumatic device engaged when the target plate is knocked down by a bullet impact in hinged movement away from the ready position, said pneumatic device including a capillary tube having a bore and length which restrict a flow of air which result in the delay of the returning movement of the target plate to the ready position, said capillary tube capable of being moved to adjust the delay of the returning movement of the target plate to the ready position, The pneumatic device may conveniently also provide a pneumatic shock absorbing function. Preferably, the spring includes a tension spring.

Preferably the pneumatic shock absorbing device comprises a flexible suction cup mounted on the base, the target plate presenting a rearwardly directed back surface, the cup located so as to be engaged by the back surface of the target when it is knocked down by a bullet impact in hinged movement away from the ready position.

In an alternative arrangement the pneumatic shock absorbing device comprises an additional flexible suction cup with another capillary tube penetrating into the suction cup, a crank arm fixed to the target plate, the cup mounted at the distal end of the arm, and a panel fixed relative to the base presenting a surface engaged by the suction cup when the target is knocked down by a bullet impact in hinged movement away from the ready position. This embodiment has advantages for use with heavier calibre bullets and higher velocity shots.

Preferably the cup mounted on the base is adapted to provide primarily a shock absorbing function, the cup on the arm a time delay; thus the former cup releases before the latter cup. It is found that with heavy calibre shooting such as the 3006 and 308, especially on shorter ranges, the second cup on the base is necessary to have sufficient shock absorption to prevent bounce-back. It is also found that the target tends to be deformed by successive shocks, even perforated, but the cup on time arm which acts on the panel fixed to the base is not affected and thus continues to give its time delay function.

An alternative for light calibre shots like 0.22 rim fire is to use only the cup on the base.

The pneumatic shock absorbing device can also be implemented by means comprising a crank arm fixed to the target plate, a cylinder fixed with respect to the base, a piston reciprocable in the cylinder and connected by a piston rod to the crank arm, the piston being cup shaped and directed to allow fast movement when the target plate is knocked down and slow movement when the target plate returns to the ready position. The present invention extends to a mechanised ballistic target which comprises a base, a target plate hingedly mounted on the base, a spring connected to act between the base and target plate tending to raise the target plate in hinged movement to a ready position to be shot at, a pneumatic device including a flexible suction cup engaged when the target plate is knocked down by a bullet impact in hinged movement away from the ready position, said suction cup adapted to restrict a flow of air through the suction cup which results in the delay of the returning movement of the target plate to the ready position.

Preferably, the suction cup has a capillary tube penetrating it. The capillary tube having a bore and length which restrict the flow of air which results in the delay of the returning movement of the target plate to the ready position. Preferably, the capillary tube is capable of being moved to adjust the delay of the returning movement of the target plate to the ready position. It will be appreciated that the mechanized ballistic target mentioned in the two previous paragraphs may have the same features as the mechanised ballistic target mentioned in paragraph five on page 3 of the specification and the subsequent paragraphs thereto. Preferably, the spring of the mechanised ballistic target of this invention includes a tension spring of which the line of action can be varied so that the target plate can be brought into a position of fine balance for effective knockdown and return movements.

BRIEF DESCRIPTION OF THE DRAWINGS

The invention is more fully described by way of examples with reference to the accompanying drawings in which.

DETAILED DESCRIPTION OF THE PREFERRED EMBODIMENT

Figure 1:
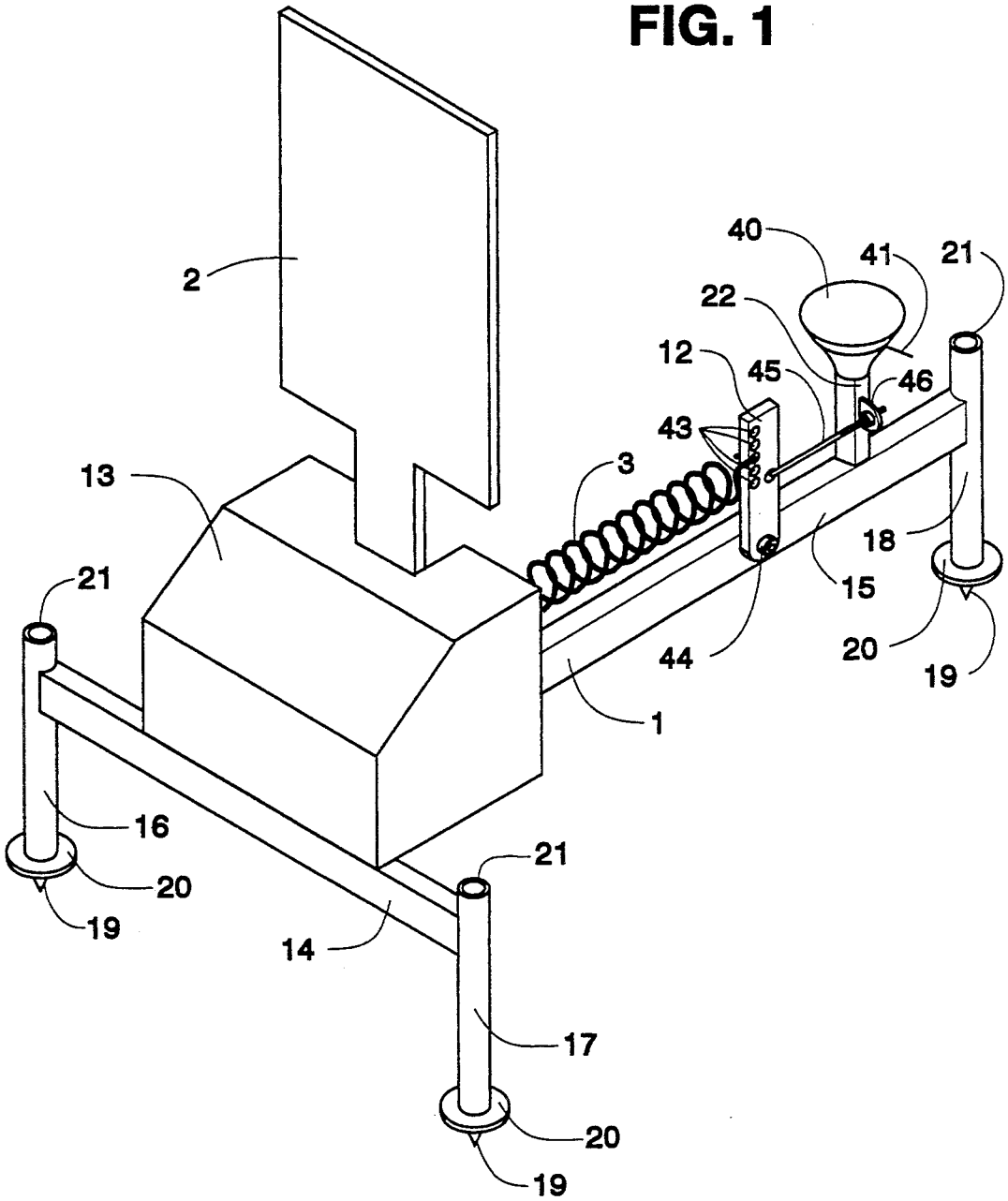
FIG. 1 is an isometric view of a first embodiment of the invention.
Figure 2:
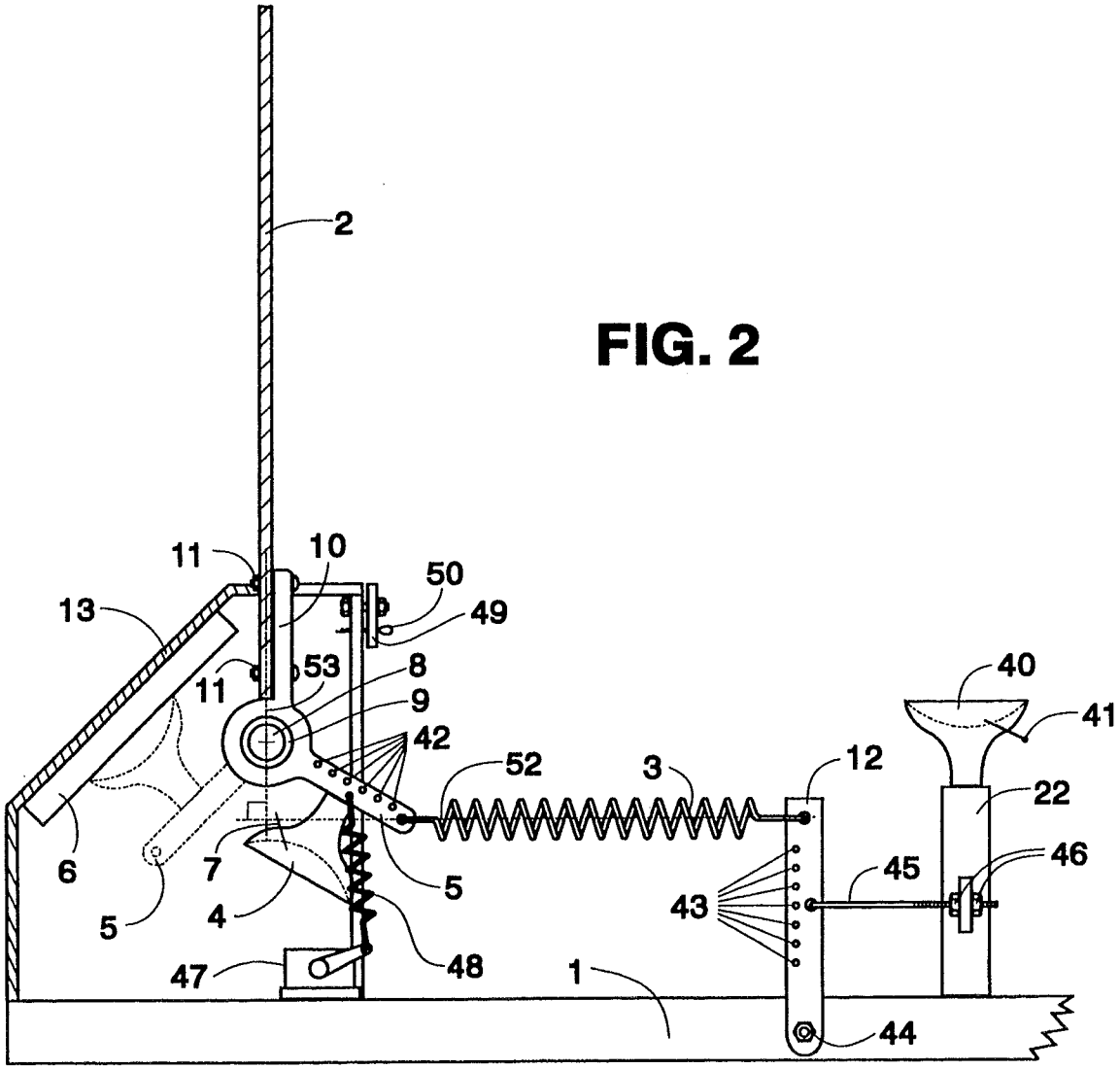
FIG. 2 is a cross sectional side elevation of the embodiment shown in figure 1.

As shown in FIGS. 1 and 2 the mechanised ballistic target comprises a base 1, a target plate 2 hingedly mounted on the base, a tension spring 3 connected to act between the base and target plate tending to raise the target plate in a hinged movement to a ready position which is shown in the drawings to be shot at, a pneumatic shock absorbing device engaged when the target plate is hocked down by a bullet impact in hinged movement away from the ready position comprising a flexible suction cup 4 mounted on a crank arm 5 which is fixed to the target plate 2 and a panel 6 which presents a surface which is engaged by the suction cup 4 when the target plate is in the knock-down position indicated by broken lines 26 in FIG. 2. The suction cup 4 has a capillary tube 7 penetrating it which provides a restricted passage for leakage of air from the suction cup, hence providing a time delay before the suction cup releases from the panel 6 to allow the target plate 2 to return under action of the spring 3 to the ready position shown. A second rubber suction cup 40 is mounted on a post 22 on the frame 1 with a capillary 41 inserted in the rubber. The height of the cup 40 may be adjusted by a screw and nut (not shows). The capillary 41 is made to penetrate the rubber more effectively and/or the capillary has a larger bore than the capillary 7 so that the cup 41 releases the target plate 2 earlier than the cup 4 so that the latter determines the time delay and effects the main time delay function. The cup 40 mainly executes a pneumatic shock absorbing function. The target plate 2 is hingedly mounted on a shaft 8 by means of a bearing 9 carrying a bush having a bracket 10 to which the plate 2 is bolted by means of bolts 11 and the crank arm 5 extends from the bush. The bearing 9 is a ball race or roller bearing type to give low friction swinging of the target. A lever 12 extends from the base 1 and one end of the spring 3 is attached to the bracket 12, the other to the distal end of the crank arm 5. The spring 3 is hooked into one of a plurality of holes 42 in the arm 5 at one end and into one of a plurality of holes 43 in the lever 12 at the other end. By selecting the holes appropriately the line of action 52 of the spring and hence the effective leverage radius 53 can be varied so that the target plate can be brought into a position of fine balance for effective knock-down and return movements. The lever 12 is hinged at 44 to the base and a threaded bolt 45 allows the spring tension to be adjusted by adjusting the nuts 46 on the bolt 45. A protective shield 13 is provided which protects the mechanism from stray bullets. The base 1 comprises a Tee section having a cross bar 14 and post 15 forming the Tee shape with legs 16 and 17 at the ends of the Tee cross bar 14 and leg 18 at the end of the Tee post 15. Feet are provided at the bottom of the legs in the forms of a tapered pin 19 and disk 20 in each case.

When the target plate 2 is hit by a bullet it swings through an angle of approximately 90° and disappears from sight of the marksman. The target plate is made out of a suitable steel which may be a mild steel for light calibre rifles and hand guns but would be an alloy steel for high powered rifles and carbines. The thickness and shape and size is dependent on the requirements of the shooter, the velocity and weight of the bullet and the range. These variables must be selected so that the impact of the bullet knocks the target plate down out of sight and brings the suction cup into engagement with the panel so as to hold it out of the sight for some moments until it is released after the time delay to return to the ready position. The target plate can, of course, also be given a desired profile for profile shooting. The spring rate of the spring 3 will also be selected with these considerations in mind thus a lighter spring in general being used for lighter plates. The size of the suction cup 4 must also be selected broadly speaking in accordance with the size of the target plate 2, a smaller cup being used with the light plate for light calibre bullets, while a bigger suction cup will be paired with a heavier and bigger plate for heavier calibre and high velocity bullets.

The time delay aspect is set by the capillary tube 7 which will be selected appropriately to the delay required. It has also been found that if the end of the capillary tube is pushed all the way through the rubber and then pulled back a short distance from the inner surfaces of the rubber of the suction cup (or other flexible polymeric material) a further degree of adjustment of the time delay can be achieved. Thus after pushing the needle through it can be withdrawn a slight amount, the amount determining an extension of the delay period. The bore and length of the capillary tube can also be selected in order to adjust the time delay.

When the target plate is knocked down the suction cup 4 comes into contact with the panel 6, and cup 41 with target plate 2 with some force driving the air out of the domed spaces inside the suction cups past the lips of the cups which have impinged on to the surfaces of the panel and plate. This provides a pneumatic shock absorbing effect which effectively absorbs the energy of the swinging target plate imparted to it by the impact of the bullet. Because the energy is absorbed in a pneumatic way it prevents a bounce-back effect so that the target does not bounce-back immediately to the ready position. This allows the shooter time to disengage the eye from the weapons sights and confirm, if necessary by means of the usual shooter's telescope, the hit by the fact of the disappearance from view of the target plate.

A mechanical counter 47 can be incorporated into the mechanism linked by spring 48 to the arm 5 to count the number of hits scored by the number of times the target plate 2 is knocked down. A light mechanical catch 49 can also be incorporated to hold the target plate down, for example during transport and before a shoot begins. The catch can be released manually by rope, cable or trip-wire releasing the catch to allow tipping the target plate up. A pin 50 can be used to keep the catch disengaged, if desired.

The provision of the legs 16, 17 and 18 is such that the pins 19 can be inserted into the open tops 21 of another similar mechanised ballistic target in a stackable way so that the targets can be stacked for transport purposes and storage.

In use the pins, of course, dig into the ground to prevent shifting on the ground.

An additional armoured steel plate (not shown) to serve as a protection plate can be hooked on to the cross bar of the Tee portion 14 of the base 1 to provide additional protection to the system from bullets.

Figure 3:
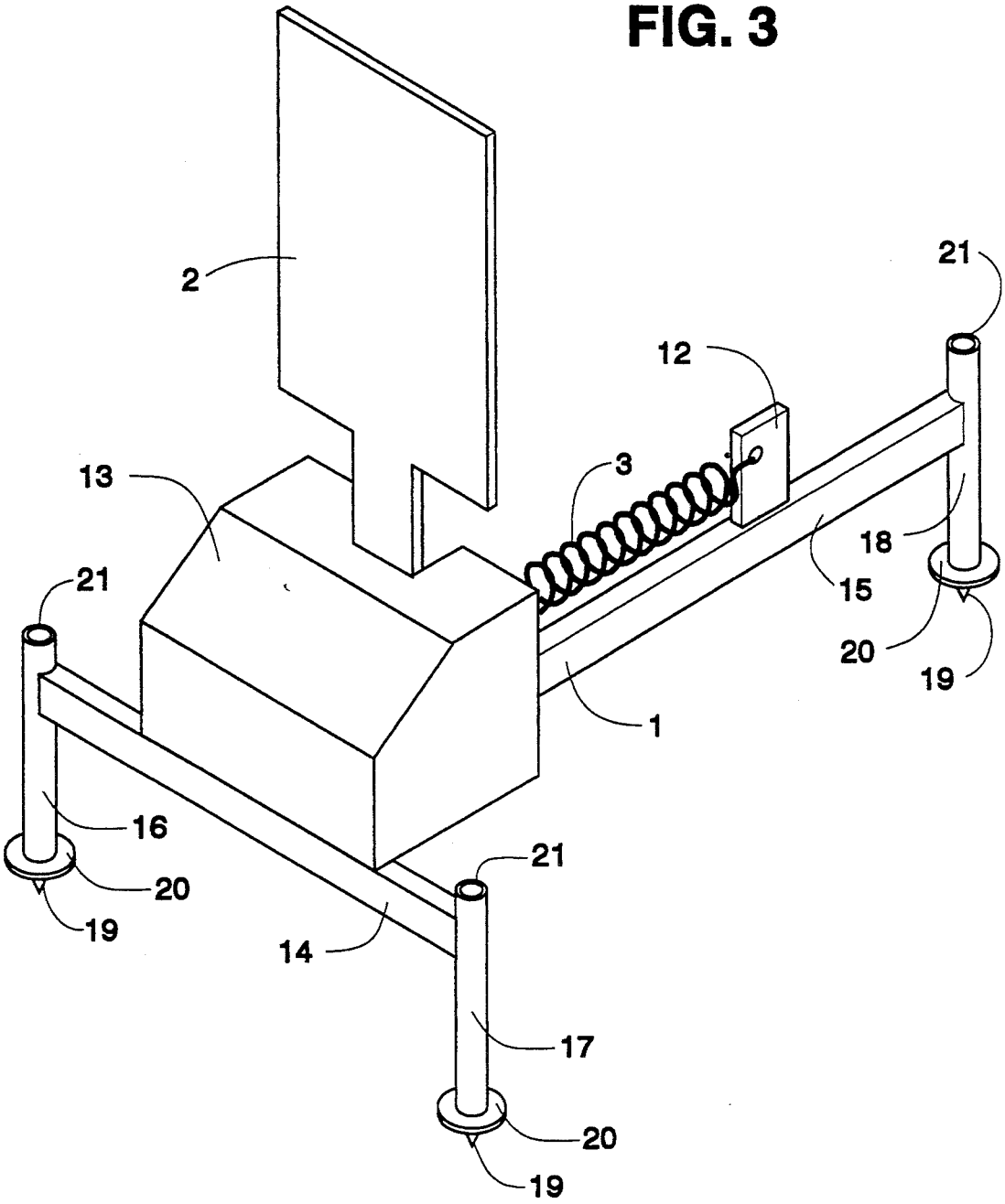
FIG. 3 is an isometric of a second preferred embodiment of the invention.
Figure 4:
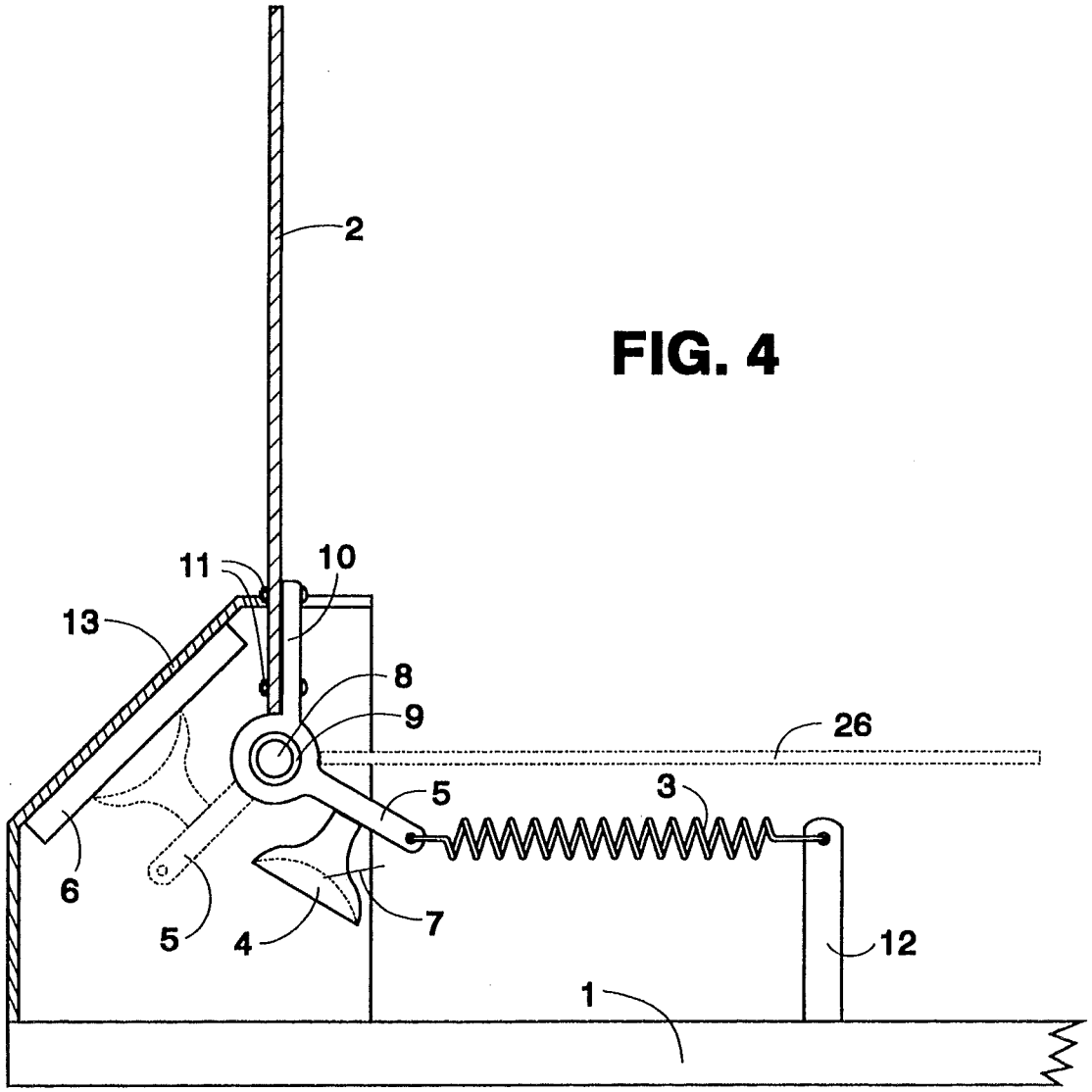
FIG. 4 is a cross sectional side elevation of the embodiment shown in figure 3.

The mechanised ballistic target shown in FIGS. 3 and 4 is in all respects the same as that shown in FIGS. 1 and 2 save that the rubber suction cup 4 is provided only on the arm 5, for light calibre work. As a better alternative (not shown) the cup could be provided only on the post 22 (see FIG. 2), the panel 6 is omitted and no suction cup is provided on the crank arm 5. The back surface of the target plate 2 then impacts on to the suction cup 4 when the target is knocked down and by the same process controlled by the capillary tube 7 the target plate is after a delay period released so as to return to the ready position. Accordingly the same reference numerals have been used for the various parts of this embodiment as have been used for the corresponding parts of the embodiment shown in FIGS. 1 and 2 and no further description of them is required.

Figure 5:
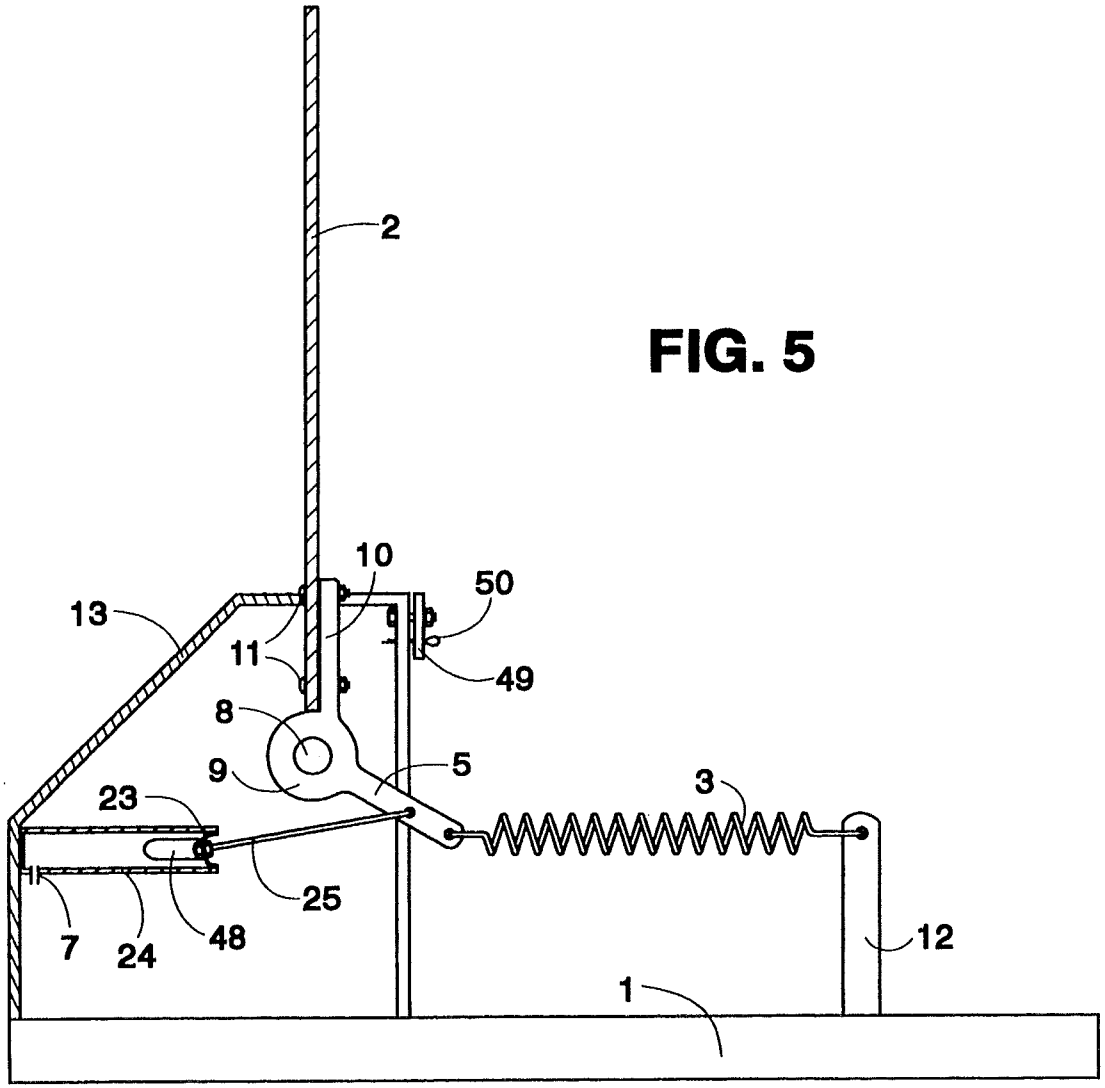
FIG. 5 is a cross sectional side elevation of an alternative embodiment.

An embodiment is shown in FIG. 5 to illustrate the pneumatic shock absorbing principle in different mechanical configuration, namely a piston 23 and cylinder 24, The piston 23 is connected by means of a piston rod 25 to the crank arm 5 and the cylinder 24 has a capillary tube 7 in the same way as the suction cups of the previous embodiment. Other components of the mechanism are the same and accordingly the same reference numerals have been used for corresponding parts in the preceding embodiment. The piston 23 is of cup shape in a flexible material rather like a bicycle pump piston so that the piston can enter the cylinder 24 very fast by means of the Mr escaping past the piston but when the piston starts to move outwardly again the lips of the cup shaped piston seal closely on the cylinder 24 and the movement outwardly is accordingly slow determined by the restricted passage of air through the capillary tube 7. Again a delay is achieved in the return of the target plate to the ready position shown. The action is different from that of the previous embodiments, however, in that there is a slow progressive return over the full swing of the target plate through the position of approximately 90° from knock down to the position shown. By contrast in the previous embodiments there is very little movement of the target plate in its knock-down position while air is gradually being returned into the space inside the suction cup 4 until suddenly the suction cup, after a suitable delay, releases and the target plate swings up quite quickly to the ready position shown. This is the preferred action. A slotted hole 48 can be provided in the wall of the cylinder 24 to allow a quick return of the target plate 2 to an upright position after an initial holding down period.

I claim:

1. A mechanised ballistic target, which comprises a base, a target plate hingedly mounted on the base, a spring connected to act between the base and target plate tending to raise the target plate in hinged movement to a ready position to be shot at, a pneumatic device engaged when the target plate is knocked down by a bullet impact in hinged movement away from the ready position, said pneumatic device including a capillary tube having a bore and length which restrict a flow of air which results in the delay of the returning movement of the target plate to the ready position, said capillary tube capable of being moved to adjust the delay of the returning movement of the target plate to the ready position.

2. A mechanised ballistic target as claimed in claim 1, in which the pneumatic device is also adapted to provide a shock absorbing function when the target plate engages the device.

3. A mechanised ballistic target as claimed in claim 1, in which the pneumatic device comprises a flexible suction cup, said capillary tube penetrating into the suction cup a crank arm fixed to the target plate, the cup mounted at the distal end of the arm, and a panel mounted on the base presenting a surface engaged by the suction cup when the target is knocked down by a bullet impact in hinged movement away from the ready position.

4. A mechanised ballistic target as claimed in claim 1, in which the pneumatic device comprises a flexible suction cup, said capillary tube penetrating into the suction cup mounted on the base, the target plate presenting a rearwardly directed back surface, the cup located so as to be engaged by the back surface of the target when it is knocked down by a bullet impact in hinged movement away from the ready position.

5. A mechanised ballistic target as claimed in claim 1, in which the spring includes a tension spring of which a line of action of the tension spring can be varied so that the target plate can be brought into a position of fine balance for effective knock-down and return movements.

6. A mechanised ballistic target as claimed in claim 3, in which the spring is a tension spring hooked into one of a plurality of holes defined by the crank arm at one end of the tension spring, a line of action of the tension spring being variable by selecting another one of the holes.

7. A mechanised ballistic target as claimed in claim 6, in which another end of the tension spring is hooked into one of a plurality of holes defined in an upwardly extending lever, said lever connected to the base, said line of action to be varied by selecting another one of the holes in the lever.

8. A mechanised ballistic target as claimed in claim 1, comprising a protective shield which protects the mechanized ballistic target from bullets.

9. A mechanised ballistic target which comprises a base, a target plate hingedly mounted on the base, a spring connected to act between the base and target plate tending to raise the target plate in hinged movement to a ready position to be shot at, a pneumatic device engaged when the target plate is knocked down by a bullet impact in hinged movement away from the ready position, said pneumatic device adapted to pneumatically delay the returning movement of the target plate to the ready position the pneumatic device comprising a crank arm fixed to the target plate, a cylinder mounted on the base, a piston reciprocable in the cylinder and connected by a piston rod to the crank arm, the piston being cup shaped and directed to allow fast movement when the target plate is knocked down and slow movement when the target plate returns to the ready position.

10. A mechanised ballistic target which comprises a base, a target plate hingedly mounted on the base, a spring connected to act between the base and target plate tending to raise the target plate in hinged movement to a ready position to be shot at, a pneumatic device engaged when the target plate is knocked down by a bullet impact in hinged movement away from the ready position, said pneumatic device adapted to pneumatically delay the returning movement of the target plate to the ready position said base having a Tee shape formed by a top bar and post, having three legs one at each end of the top bar and post of the Tee shape, a foot of each leg comprising a ground engaging spike and disk.

11. A mechanised ballistic target which comprises: a base; a target plate hingedly mounted on the base; a spring connected to act between the base and target plate tending to raise the target plate in hinged movement to a ready position to be shot at; a pneumatic device including a flexible suction cup engaged when the target plate is knocked down by a bullet impact in hinged movement away from the ready position, said suction cup having a capillary tube penetrating it, said capillary tube having a bore and length which restrict the flow of air which results in the delay of the returning movement of the target plate to the ready position, the capillary tube capable of being moved to adjust the delay of the returning movement of the target plate to the ready position.

12. A mechanised ballistic target, which comprises: a base; a target plate hingedly mounted on the base, the target plate presenting a rearwardly directed back surface; a spring connected to act between the base and target plate tending to raise the target plate in hinged movement to a ready position to be shot at; a pneumatic device including a flexible suction cup which is mounted on the base, the suction cup being located so as to be engaged by the back surface of the target plate when the target plate is knocked down by a bullet impact in hinged movement away from the ready position, said suction cup adapted to restrict a flow of air through the suction cup which results in the delay of the returning movement of the target plate to the ready position.

13. A mechanism ballistic target as claimed in claim 12, in which the spring includes a tension spring of which a line can be varied so that the target plate can be brought into a position of fine balance for effective knock-down and return movements.

14. A mechanised ballistic target as claimed in claim 12, comprising a protective shield which protects the mechanized ballistic target from bullets.

15. A mechanised ballistic target which comprises: a base; a target plate hingedly mounted on the base; a spring connected to act between the base and target plate tending to raise the target plate in hinged movement to a ready position to be shot at; a pneumatic device including a flexible suction cup engaged when the target plate is knocked down by a bullet impact in hinged movement away from the ready position, said suction cup adapted to restrict a flow of air through the suction cup which results in the delay of the returning movement of the target plate to the ready position; a crank arm fixed to the target plate, the suction cup mounted at a distal end of the arm, and a panel mounted on the base presenting a surface engaged by the suction cup when the target is knocked down by a bullet impact in hinged movement away from the ready position, the spring being a tension spring hooked into one of a plurality of holes defined in the crank arm at one end of the tension spring, a line of action of the tension spring being variable by selecting another one of the holes.

16. A mechanised ballistic target as claimed in claim 15, in which another end of the tension spring is hooked into one of a plurality of holes defined in a upwardly extending lever, said lever being connected to the base, said line of action being variable by selecting another one of the holes in the lever.

* * * * *